US008222830B2

(12) United States Patent
Nagata et al.

(10) Patent No.: US 8,222,830 B2
(45) Date of Patent: Jul. 17, 2012

(54) DISCHARGE LAMP LIGHTING DEVICE, LIGHTING FIXTURE, AND LIGHTING SYSTEM

(75) Inventors: Satoru Nagata, Kobe (JP); Jun Kumagai, Suita (JP); Naoki Komatsu, Kobe (JP)

(73) Assignee: Panasonic Corporation, Osaka (JP)

( * ) Notice: Subject to any disclaimer, the term of this patent is extended or adjusted under 35 U.S.C. 154(b) by 414 days.

(21) Appl. No.: 12/531,554

(22) PCT Filed: Mar. 13, 2008

(86) PCT No.: PCT/JP2008/054595

§ 371 (c)(1),
(2), (4) Date: Sep. 16, 2009

(87) PCT Pub. No.: WO2008/117673

PCT Pub. Date: Oct. 2, 2008

(65) Prior Publication Data

US 2010/0084988 A1 Apr. 8, 2010

(30) Foreign Application Priority Data

Mar. 27, 2007 (JP) ..... 2007-083013

(51) Int. Cl.
*H05B 41/26* (2006.01)
*H05B 37/02* (2006.01)

(52) U.S. Cl. ..... 315/246; 315/209 R; 315/224; 315/307

(58) Field of Classification Search ..... 315/246, 315/209 R, 224, 307, 308
See application file for complete search history.

(56) References Cited

U.S. PATENT DOCUMENTS

| | | | | |
|---|---|---|---|---|
| 5,932,976 | A | 8/1999 | Maheshwari et al. | |
| 6,380,694 | B1 | 4/2002 | Uchihashi et al. | |
| 6,437,515 | B1 * | 8/2002 | Kamoi et al. | 315/209 R |
| 6,791,281 | B2 | 9/2004 | Mita | |
| 7,425,802 | B2 * | 9/2008 | Kumagai et al. | 315/291 |

(Continued)

FOREIGN PATENT DOCUMENTS

EP 1286573 2/2003

(Continued)

OTHER PUBLICATIONS

Search report from E.P.O., mail date is May 11, 2011.

(Continued)

*Primary Examiner* — Daniel D Chang
(74) *Attorney, Agent, or Firm* — Greenblum & Bernstein, P.L.C.

(57) ABSTRACT

A discharge lamp lighting device includes: a direct current power supply circuit that outputs direct current power; an inverter circuit that converts the direct current power, which is outputted by the direct current power supply circuit, into alternating current power, and supplies the alternating current power to a discharge lamp; a control circuit that controls a frequency of an output of the inverter circuit (operation frequency); and a starting detection circuit that detects beginning (starting) of a discharge in the discharge lamp. The control circuit operates in a starting improvement mode, in which the operation frequency is lowered than an operation frequency in a lighting mode, during a predetermined time from when the starting of the discharge lamp is detected by the starting detection circuit 4 during a no-load mode. Thereafter, the control circuit shifts to the lighting mode in which lighting of the discharge lamp is maintained. In such a way, the discharge lamp can be smoothly shifted to stable lighting.

12 Claims, 16 Drawing Sheets

U.S. PATENT DOCUMENTS

| | | | |
|---|---|---|---|
| 2003/0034744 | A1 | 2/2003 | Toyama |
| 2003/0222594 | A1 | 12/2003 | Mita |
| 2007/0052371 | A1 | 3/2007 | Fukuta et al. |
| 2007/0063659 | A1 | 3/2007 | YAamashita et al. |
| 2009/0146579 | A1 | 6/2009 | Goriki et al. |
| 2009/0236999 | A1 | 9/2009 | Yufuku et al. |

FOREIGN PATENT DOCUMENTS

| | | |
|---|---|---|
| EP | 1694101 | 8/2006 |
| JP | 2000-286086 | 10/2000 |
| JP | 2004-055512 | 2/2004 |
| JP | 2004-265707 | 9/2004 |
| JP | 2004-265714 | 9/2004 |
| JP | 2005-038814 | 2/2005 |
| JP | 2005-158365 | 6/2005 |
| JP | 2005-310628 | 11/2005 |
| JP | 2007-026830 | 2/2007 |

OTHER PUBLICATIONS

Canada Office action, mail date is Jul. 15, 2011.
Japan Office action, dated Oct. 18, 2011 along with an english translation thereof.

* cited by examiner (a)

(b)

(c)

DISCHARGE LAMP LIGHTING DEVICE, LIGHTING FIXTURE, AND LIGHTING SYSTEM

TECHNICAL FIELD

The present invention relates to a discharge lamp lighting device, a lighting fixture using the discharge lamp lighting device, and a lighting system using the lighting fixture.

BACKGROUND ART

Heretofore, a discharge lamp lighting device has been proposed, which includes an inverter circuit that converts direct current power into alternating current power and supplies the alternating current power to a discharge lamp (for example, refer to Patent Literature 1).

As this type of discharge lamp lighting device, for example, there is one shown in FIG. 15. This discharge lamp lighting device includes: a direct current power supply circuit 1 that converts a voltage of a direct current power supply E; an inverter circuit 2 that converts direct current power, which is outputted by the direct current power supply circuit 1, into alternating current power and supplies the alternating current power to a discharge lamp DL; and a control circuit 3 that controls a frequency of such an output of the inverter circuit 2. The discharge lamp DL is a so-called high pressure discharge lamp, and has an advantage that light distribution control thereof is easy since a relatively high luminous flux can be obtained with respect to a size thereof and the discharge lamp DL concerned can be therefore handled like a point source, but requires a high voltage pulse of several kilovolts for starting thereof.

The direct current power supply circuit 1 includes the direct current power supply circuit 1 composed of a well-known back converter including: a series circuit including a switching device Q2, an inductor L2, a capacitor C2 and a resistor R, which is connected between both terminals of the direct current power supply E; a diode D2 connected to a node between the resistor R and the direct current power supply E and a node between the switching device Q2 and the inductor L2; and a power supply control unit 1*a* that is made, for example, of a microcomputer and drives the switching device Q2. The direct current power supply circuit 1 includes voltage dividing resistors Ra and Rb connected between both terminals of the capacitor C2, and the power supply control unit 1*a* controls a frequency and a duty ratio for turning on/off the switching device Q2 based on a both-terminal voltage of the capacitor C2, which is divided by the voltage dividing resistors Ra and Rb.

Moreover, the inverter circuit 2 is an inverter circuit of a so-called full bridge type, which includes: two series circuits, each of which is composed of two switching devices among switching devices Q3 to Q6, and are connected in parallel to each other between output terminals of the direct current power supply circuit 1; and a series circuit including a parallel circuit composed of the discharge lamp DL and a capacitor Cr, and an inductor Lr, which are connected between a node between the switching devices Q3 and Q4 and a node between the switching devices Q5 and Q6.

The control circuit 3 drives the switching devices Q3 to Q6, which are located diagonally to each other, to turn on/off simultaneously, and drives the switching devices Q3 to Q6, which are connected in series to each other, to turn on/off alternately, thereby supplies the alternating current power to the discharge lamp DL.

As shown in FIG. 16, after the power supply is turned on, the conventional control circuit 3 operates, for a predetermined time, in a no-load mode of alternately repeating two periods in which, during one period, an on/off frequency of the switching devices Q3 to Q6 (hereinafter, referred to as an "operation frequency") is set as high as approximately a resonance frequency of the inductor Lr and the capacitor Cr, and during the other period, the operation frequency is dropped more than the resonance frequency. Then, after the no-load mode is ended, the control circuit 3 proceeds to a lighting mode of dropping the operation frequency more than the resonance frequency. Specifically, during the period of raising the operation frequency, a discharge is started in the discharge lamp DL, and during the period of dropping the operation frequency, such a glow discharge started in the discharge lamp DL is shifted to an arc discharge, and the arc discharge is maintained in the lighting mode.

[Patent Literature 1]

Japanese Patent Laid-Open Publication No. 2004-265707

SUMMARY OF INVENTION

Technical Problem

However, when the discharge occurs in the discharge lamp DL as in a period T1 of FIG. 16, a both-terminal voltage of the discharge lamp DL (lamp voltage) drops, the resonating inductor Lr becomes a current restricting factor during a period T2 of raising the operation frequency for the next time, whereby a current flowing through the discharge lamp DL (lamp current) has run short to cause fading as in a period T3. As a result, the discharge lamp DL has flickered at a starting time thereof, and it has taken longer for the discharge lamp DL to reach stable lighting.

The present invention has been made in consideration of the above-described circumstances. It is an object of the present invention to provide a discharge lamp lighting device capable of smoothly shifting a discharge lamp to the stable lighting, a lighting fixture using the discharge lamp lighting device, and a lighting system using the lighting fixture.

Solution to Problem

An invention of claim 1 includes: a direct current power supply circuit that outputs direct current power; an inverter circuit that includes a resonance circuit having at least one capacitor and at least one inductor, and converts a direct current voltage, which is outputted by the direct current power supply circuit, into an alternating current voltage; a starting detection circuit that detects starting of a discharge in a discharge lamp; and a control circuit that controls the inverter circuit. At a time of starting the discharge lamp, the control circuit first operates in a no-load mode in which a voltage for starting a glow discharge is applied to the discharge lamp by setting a frequency of an output of the inverter circuit at approximately a resonance frequency of the resonance circuit included by the inverter circuit. The control circuit shifts to a starting improvement mode, in which the glow discharge in the discharge lamp is shifted to an arc discharge, when the starting of the discharge in the discharge lamp is detected by the starting detection circuit during the no-load mode. And the control circuit shifts to a lighting mode in which the arc discharge is maintained by lowering the frequency of the output of the inverter circuit than the resonance frequency of the resonance circuit after the starting improvement mode is continued for a predetermined time.

In accordance with this invention, the control circuit shifts to the starting improvement mode when the starting of the discharge in the discharge lamp is detected by the starting detection circuit, whereby the discharge lamp can be smoothly shifted to stable lighting.

An invention of claim 2 according to the invention of claim 1 is characterized in that, in the starting improvement mode, the control circuit sets the frequency of the output of the inverter circuit at approximately the resonance frequency of the resonance circuit.

An invention of claim 3 according to the invention of claim 1 is characterized in that, in the starting improvement mode, the control circuit lowers the frequency of the output of the inverter circuit than a frequency thereof in the lighting mode.

An invention of claim 4 according to the invention of claim 1 is characterized in that, in the starting improvement mode, the control circuit controls the inverter circuit to apply a direct current voltage to the discharge lamp.

An invention of claim 5 according to any invention of claims 1 to 4 further includes a state detection circuit that detects a fading state in which the arc discharge is not generated in the discharge lamp, wherein the control circuit returns to the no-load mode when the fading state is detected by the state detection circuit in either the starting improvement mode or the lighting mode.

In accordance with this invention, the discharge lamp can be shifted to the lighting mode more stably.

An invention of claim 6 according to any invention of claims 1 to 5 is characterized in that the starting detection circuit detects the starting of the discharge based on a change of a voltage in the resonance circuit.

An invention of claim 7 according to any invention of claims 1 to 5 is characterized in that the starting detection circuit detects the starting of the discharge based on a change of a current in the resonance circuit.

An invention of claim 8 according to any invention of claims 1 to 5 is characterized in that the starting detection circuit detects the starting of the discharge by detecting a current flowing through the discharge lamp.

An invention of claim 9 includes: the discharge lamp lighting device according to any one of claims 1 to 8; a socket that is electrically connected to the discharge lamp lighting device and has the discharge lamp attached thereto; and a fixture body that houses the discharge lamp lighting device therein.

An invention of claim 10 includes: the lighting fixtures according to claim 9; and a control device that controls the respective lighting fixtures.

Advantageous Effect of Invention

In accordance with the invention of claim 1, at the time of starting the discharge lamp, the control circuit that controls the inverter circuit shifts to the starting improvement mode, in which the glow discharge in the discharge lamp is shifted to the arc discharge, when the starting of the discharge in the discharge lamp is detected by the starting detection circuit, and then shifts to the lighting mode, in which the arc discharge is maintained by lowering the frequency of the output of the inverter circuit than the resonance frequency of the resonance circuit, after the starting improvement mode is continued for the predetermined time. Accordingly, the discharge lamp can be smoothly shifted to the stable lighting.

In accordance with the invention of claim 5, the control circuit returns to the no-load mode when the fading state is detected by the state detection circuit in either the starting improvement mode or the lighting mode. Accordingly, the discharge lamp can be shifted to the lighting mode more stably.

BRIEF DESCRIPTION OF DRAWINGS

FIG. 13(*a*) shows a case where an operation returns from a starting improvement mode to a no-load mode; and FIG. 13(*b*) shows a case where the operation shifts from the starting improvement mode to a lighting mode.

REFERENCE SIGNS LIST

Figure 1:
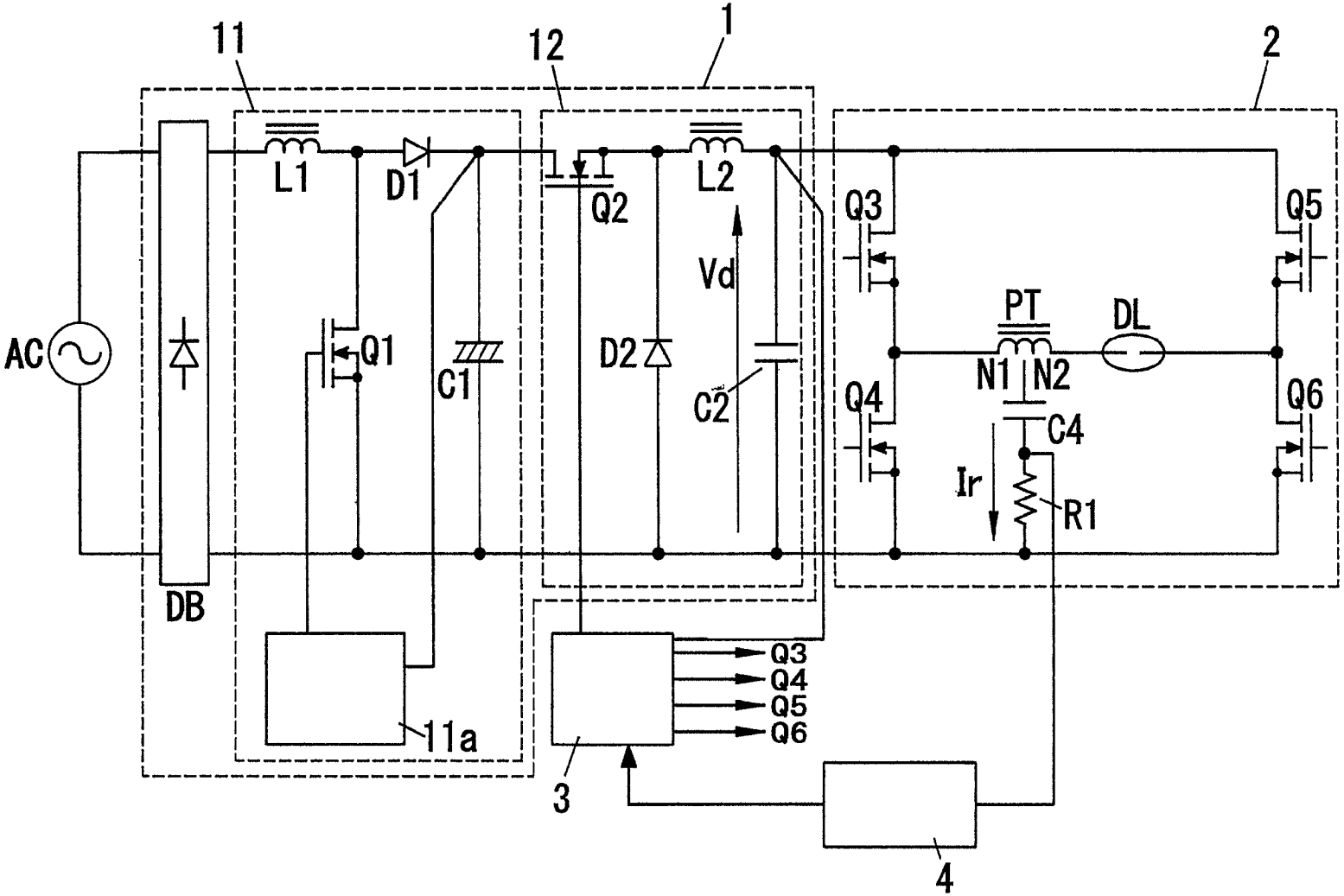
FIG. 1 is a circuit diagram showing Embodiment 1 of the present invention.

1 Direct current power supply circuit
2 Inverter circuit
3 Control circuit
4 Starting detection circuit
DL Discharge lamp

DESCRIPTION OF EMBODIMENTS

A description will be made below of embodiments of the present invention while referring to the drawings.

Embodiment 1

As shown in FIG. 1, this embodiment includes: a direct current power supply circuit 1 that creates direct current power by using an alternating current power supply AC; and an inverter circuit 2 that converts a direct current voltage, which is outputted by the direct current power supply circuit, into an alternating current voltage and supplies the alternating current voltage to a discharge lamp DL. The discharge lamp DL is composed of a so-called high pressure discharge lamp.

The direct current power supply circuit 1 includes: a diode bridge DB that performs full-wave rectification for alternating current power inputted from the alternating current power supply AC; a step-up unit 11 that smoothes and raises an output voltage of the diode bridge DB; and a step-down unit 12 that drops the output voltage of the step-up unit 11. The step-up unit 11 is composed of: a series circuit of an inductor L1, a diode D1 and a capacitor C1, which are connected between direct current output terminals of the diode bridge DB; a switching device Q1, in which one terminal is connected to a node between the inductor L1 and the diode D1, and the other terminal is connected to the low voltage-side output terminal of the diode bridge DB; and a step-up control unit 11*a* that drives the switching device Q1 to turn on/off. The step-up unit 11 is a well-known boost converter that outputs a both-terminal voltage of the capacitor C1 as an output voltage thereof. The step-up control unit 11*a* controls a duty ratio for turning on/off the switching device Q1, for example, so as to constantly maintain the both-terminal voltage of the capacitor C1, and can be composed, for example, of a microcomputer such as MC33262. The step-down unit 12 is a well-known back converter, which includes: a series circuit of a switching device Q2, an inductor L2 and a capacitor C2, which are connected between output terminals of the step-up unit 11; and a diode D2 connected to a node between the switching device Q2 and the inductor L2, and outputs a both-terminal voltage of the capacitor C2 as an output voltage Vd thereof.

The inverter circuit 2 is an inverter circuit of a so-called full bridge type, in which two series circuits, each of which has two switching devices among switching devices Q3 to Q6, are connected between output terminals of the direct current power supply circuit 1 in parallel to each other, a series circuit of a primary winding N1 and secondary winding N2 of a pulse transformer Pt is connected between a node between the switching devices Q3 and Q4 of one of the series circuits and a node between the switching devices Q5 and Q6 of the other series circuit in series to the discharge lamp DL, and a series circuit of a capacitor C4 and a resistor R1 is connected between a node between the primary winding N1 and secondary winding N2 of the pulse transformer PT and a low voltage-side output terminal of the direct current power supply circuit 1.

Moreover, this embodiment includes a control circuit 3 that individually drives the switching device Q2 of the step-down unit 12 of the direct current power supply circuit 1 and the respective switching devices Q3 to Q6 of the inverter circuit 2. The control circuit 3 detects the output voltage Vd of the direct current power supply circuit 1, and controls a frequency and a duty ratio for turning on/off the switching device Q2 of the direct current power supply circuit 1 so as to maintain the output voltage Vd of the direct current power supply circuit 1 at a predetermined voltage. Moreover, the control circuit 3 alternately switches a state where the switching devices Q3 and Q6 as one of pairs located diagonally to each other are individually turned on and the switching devices Q4 and Q5 as the other pair are individually turned off and a state where the switching devices Q3 and Q6 as one of the pairs are individually turned off and the switching devices Q4 and Q5 are individually turned on. A frequency for this switching is hereinafter referred to as an "operation frequency". In this embodiment, a frequency of the voltage applied to the discharge lamp DL is equal to the operation frequency. The control circuit 3 can be composed of a microcomputer, for example, such as ST72215 made by STMicroelectronics.

Furthermore, this embodiment includes a starting detection circuit 4 that detects starting of a discharge in the discharge lamp DL, that is, starting of the discharge lamp DL based on a current Ir flowing through the resistor R1 of the inverter circuit 2 (hereinafter, referred to as a "resonance current").

Figure 2:
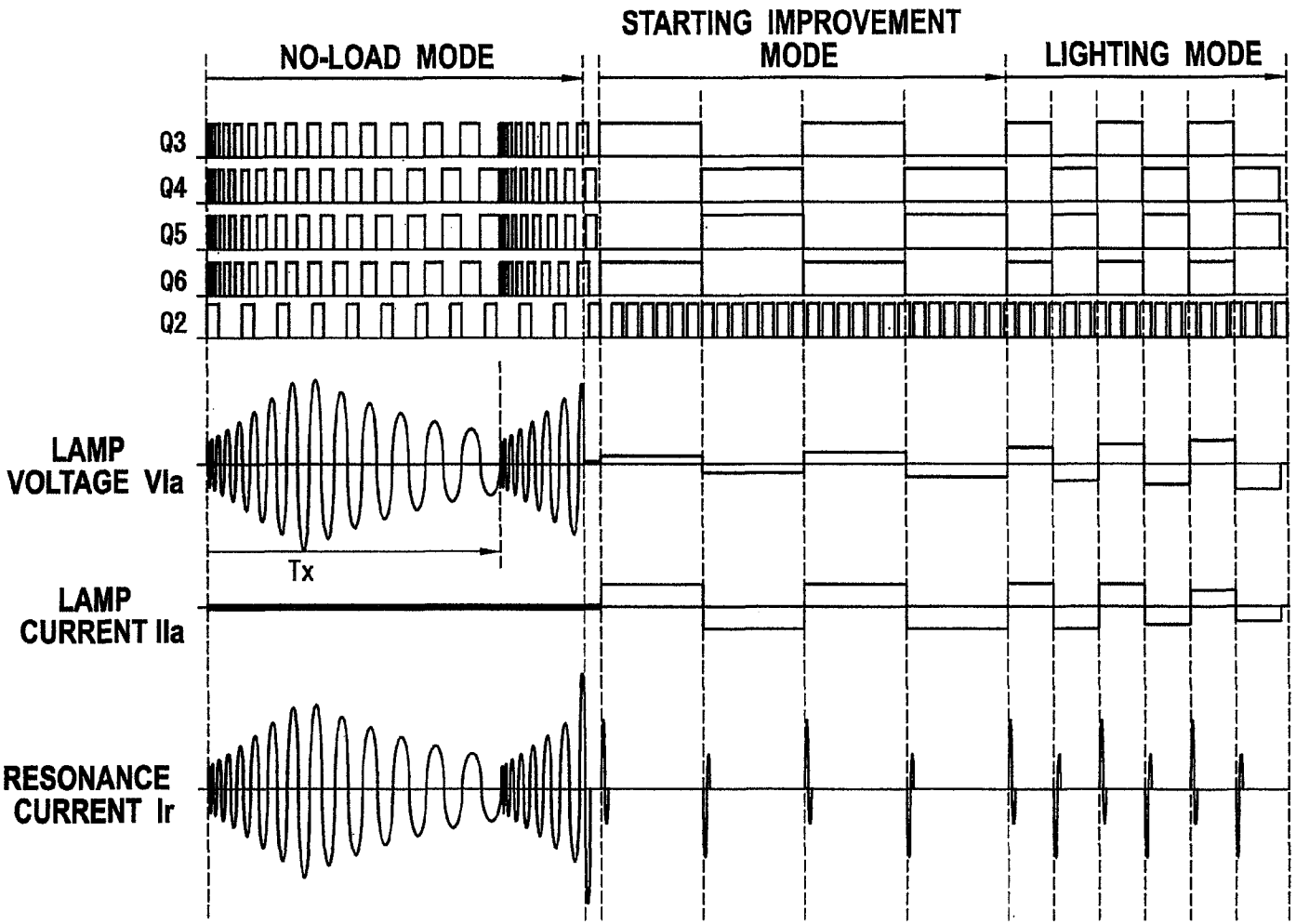
FIG. 2 is an operation instruction chart of Embodiment 1, showing on/off states of the respective switching devices, a waveform of a lamp voltage, a waveform of a lamp current and a waveform of a resonance current while an axis of abscissas is being taken as a time.
Figure 3:
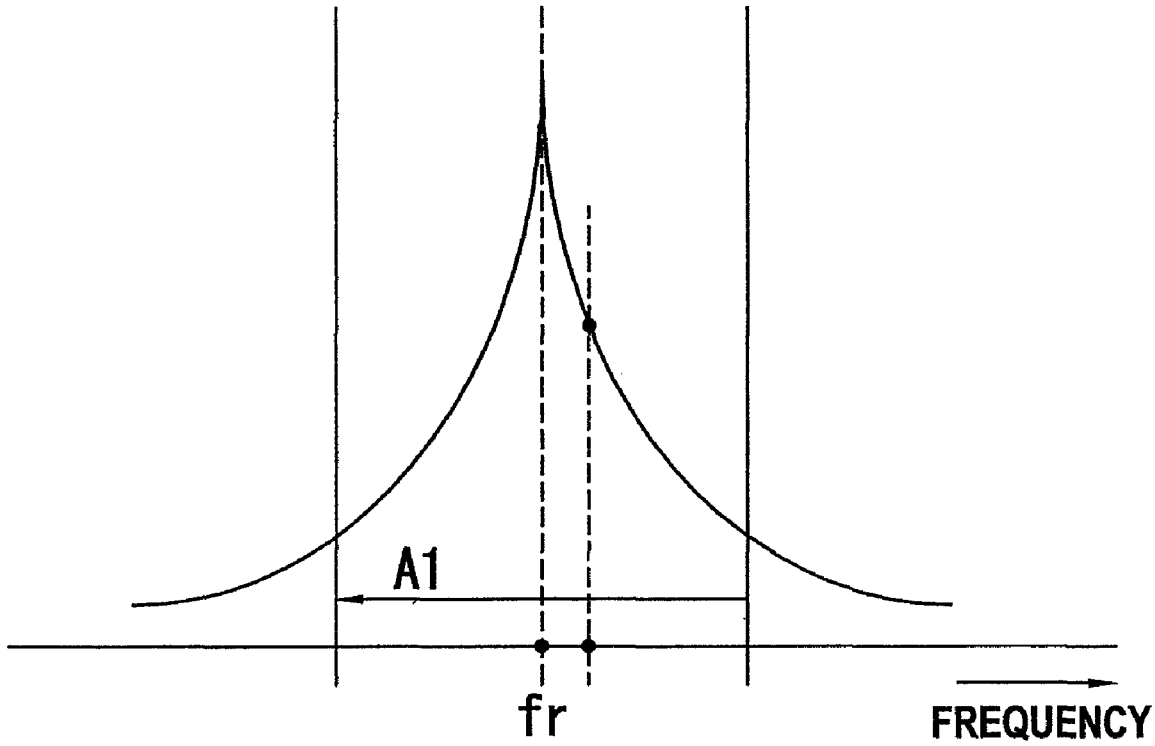
FIG. 3 is an operation instruction chart of Embodiment 1.

A description will be made of operations of the control circuit 3 by mainly using FIG. 2. When the power supply is turned on, the control circuit 3 first operates in a no-load mode. In the no-load mode, as shown by an arrow A1 in FIG. 3, the control circuit 3 changes the operation frequency from a frequency higher than a resonance frequency fr of a series circuit of the primary winding N1 and the capacitor C1, which is connected to the node between the switching devices Q3 and Q4 in the pulse transformer PT (hereinafter, simply referred to as a "resonance frequency"), toward a frequency lower than the resonance frequency concerned while taking a predetermined time Tx. At this time, a voltage obtained by raising a voltage generated between both terminals of the primary winding N1 of the pulse transformer PT is generated on the secondary winding N2 of the pulse transformer PT, whereby a high voltage is applied to the discharge lamp DL, and the discharge lamp DL is started by this high voltage.

The starting detection circuit 4 detects the starting of the discharge lamp DL (that is, a dielectric breakdown in the discharge lamp DL) based on the fact that a waveform of the resonance current Ir has become a pulse waveform. When the starting of the discharge lamp DL is detected by the starting discharge circuit 4, the control circuit 3 operates in a starting improvement mode for a predetermined time. In the starting improvement mode, the control circuit 3 sets the operation frequency at a frequency fa as low as several ten to several hundred hertz. Moreover, after the starting improvement mode, the control circuit 3 individually raises the duty ratio (on-duty) and frequency for turning on/off the switching device Q2 of the direct current power supply circuit 1 more than in the no-load mode.

When the above-described predetermined time elapses and the starting improvement mode is ended, the control circuit 3 proceeds to a lighting mode of maintaining lighting of the discharge lamp DL. In the lighting mode, the control circuit 3 sets the operation frequency fb at several hundred hertz. Specifically, the operation frequency fa in the starting improvement mode is lower than the operation frequency fb in the lighting mode.

In accordance with the above-described configuration, the control circuit 3 shifts to the starting improvement mode when the starting of the discharge lamp DL is detected in the no-load mode, whereby it becomes possible to smoothly start up the discharge lamp DL to stable lighting without causing fading.

Figure 4:
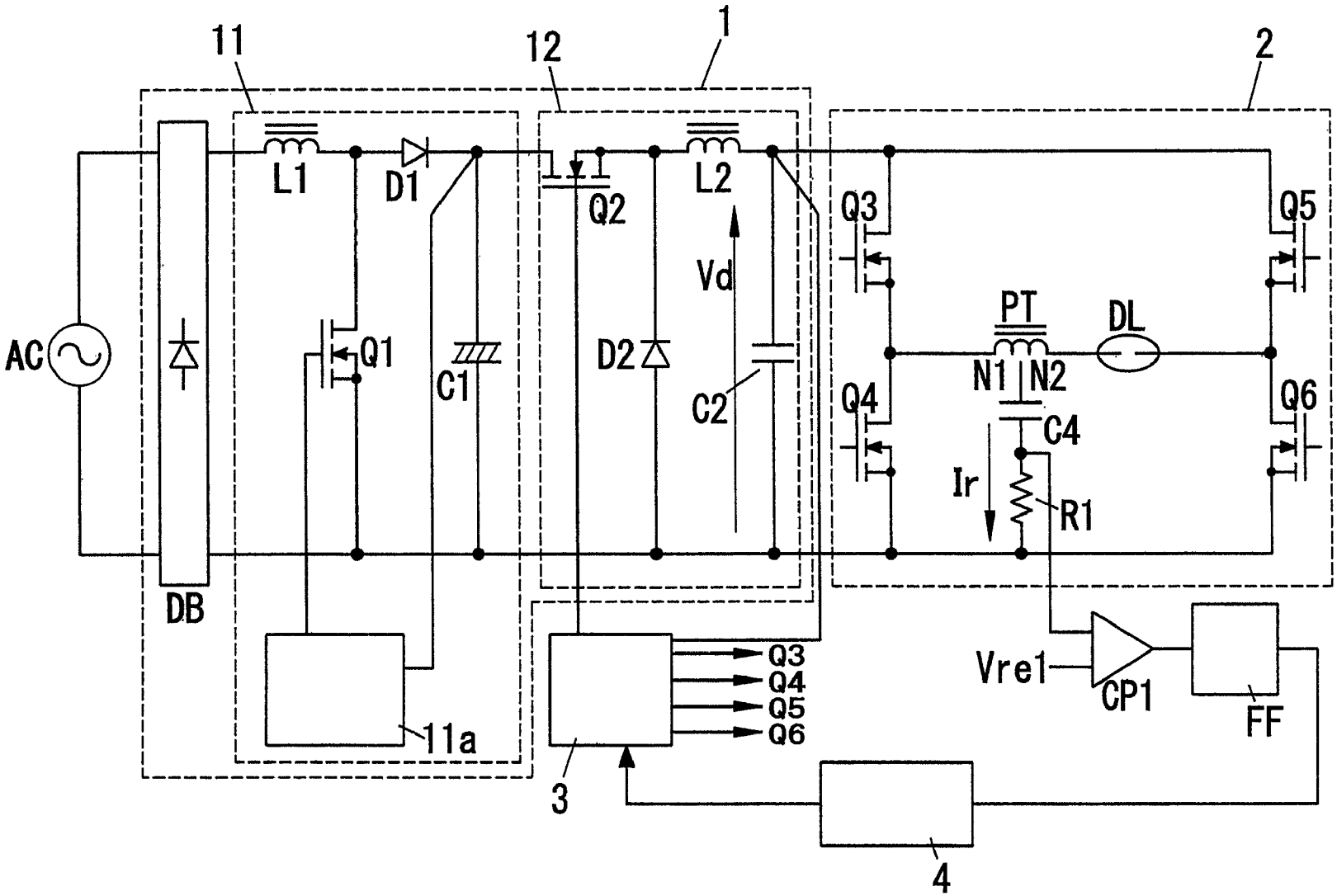
FIG. 4 is a circuit diagram showing another form of Embodiment 1.

Note that, as shown in FIG. 4, a comparator CP1, which compares a voltage at a node between the capacitor C4 and the resistor R1 with a reference voltage Vre1, and a flip-flop circuit FE may be provided between the starting detection circuit 4 and the node between the capacitor C4 and the resistor R1. If this configuration is adopted, then a withstand voltage required for circuit components composing the starting detection circuit 4 can be lowered.

Embodiment 2

A basic configuration of this embodiment is common to that of Embodiment 1, and accordingly, a description of common portions will be omitted by assigning the same reference numerals thereto, and a description of only different portions will be made.

Figure 5:
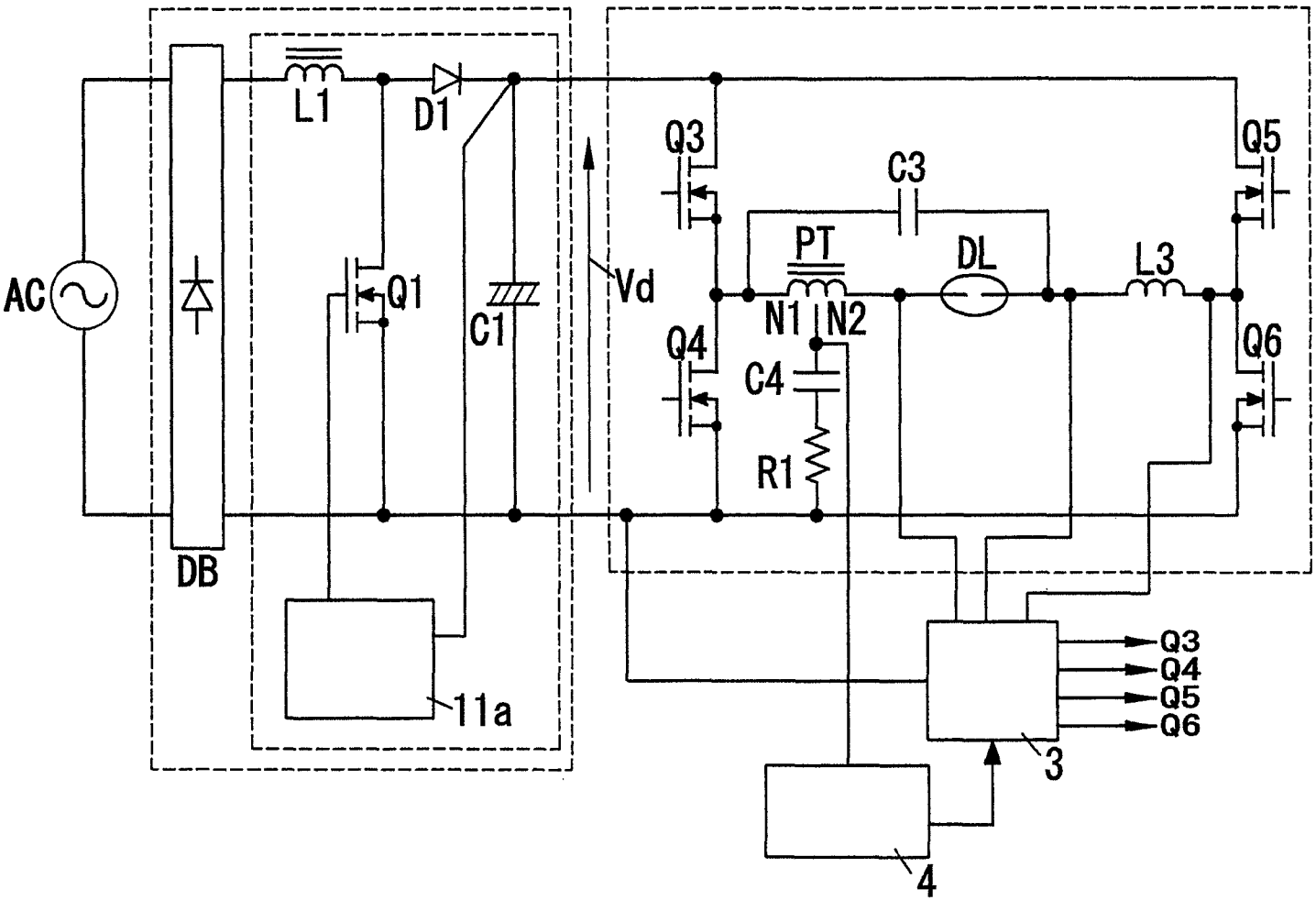
FIG. 5 is a circuit diagram showing Embodiment 2 of the present invention.

In this embodiment, as shown in FIG. 5, the step-down unit 12 is not provided in the direct current power supply circuit 1, and the output voltage of the step-up unit 11 becomes an output voltage of the direct current power supply circuit 1.

Moreover, this embodiment includes: a capacitor C3 connected in parallel to a series circuit of the pulse transformer PT and the discharge lamp DL; and an inductor L3 connected between the discharge lamp DL and the node between the switching devices Q5 and Q6.

Figure 6:
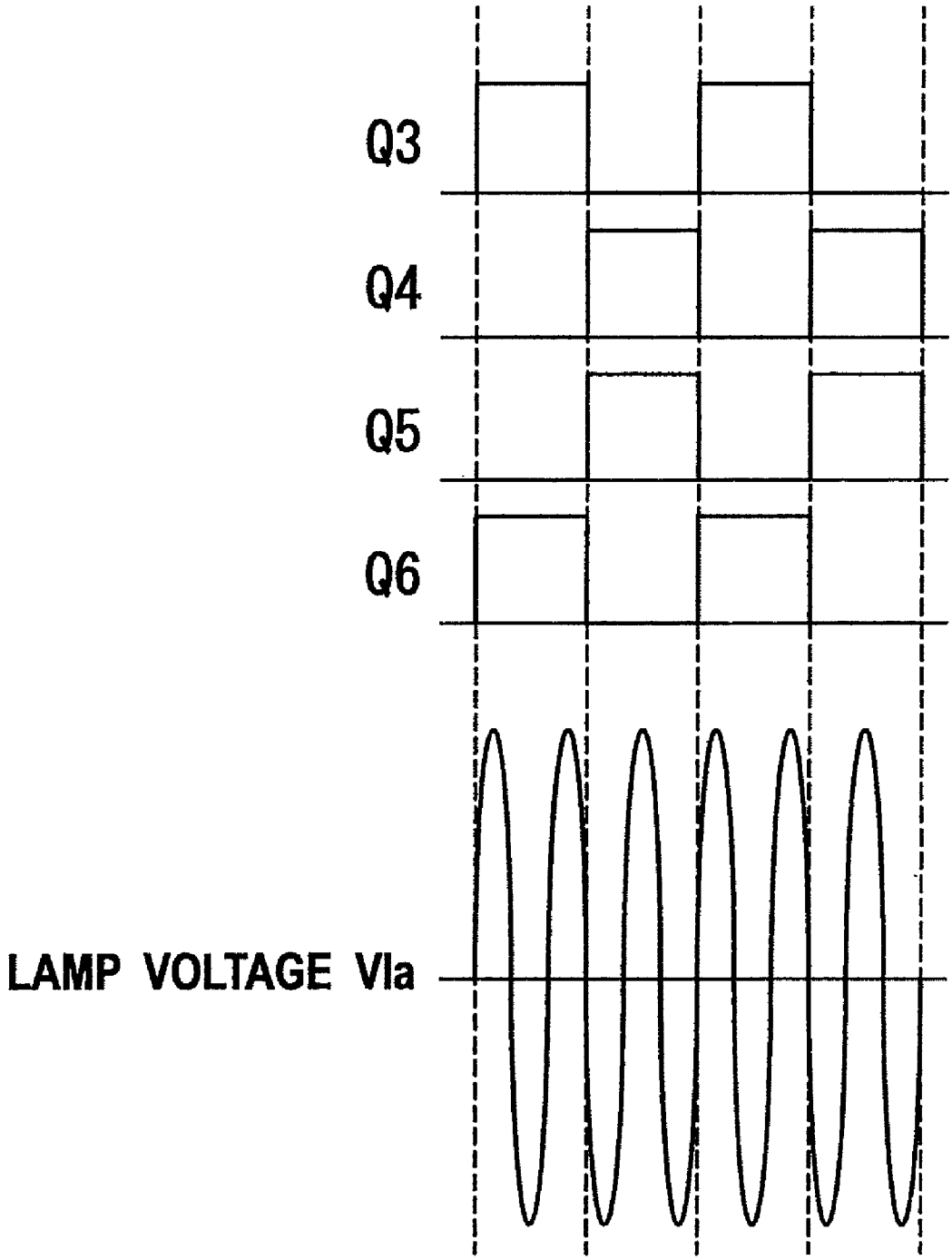
FIG. 6 is an instruction chart showing a relationship between on/off states of switching devices and a lamp voltage in Embodiment 2.
Figure 7:
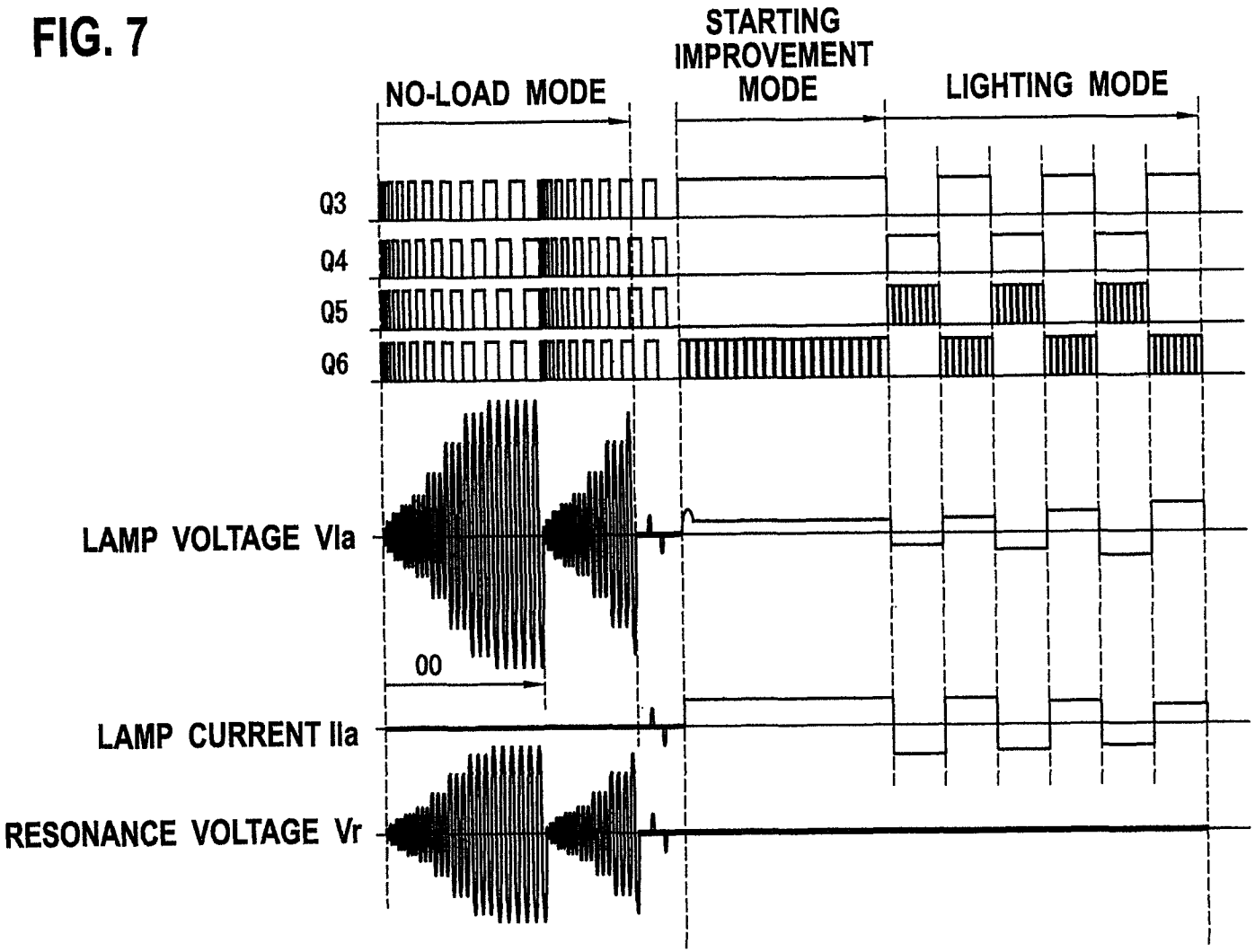
FIG. 7 is an operation instruction chart of Embodiment 2, showing the on/off states of the respective switching devices, a waveform of the lamp voltage, a waveform of a lamp current and a waveform of a resonance current while an axis of abscissas is being taken as a time.

In this embodiment, as shown in FIG. 6, a phase of a both-terminal voltage (lamp voltage) Vla of the discharge lamp DL changes by three cycles during one cycle (one on and one off) of the operation of each of the switching devices Q3 to Q6. Specifically, a frequency of the lamp voltage Vla becomes three times the operation frequency. Accordingly, as shown in FIG. 7, in the no-load mode, a control circuit 3 in this embodiment gradually lowers the operation frequency from a frequency higher than one-third of the resonance frequency fr to a frequency of one-third of the resonance frequency fr while taking the predetermined time Tx. In such a way, an output voltage of an inverter circuit 2, that is, the frequency of the lamp voltage Vla becomes approximately the resonance frequency fr.

Moreover, the starting detection circuit 4 detects the starting of the discharge lamp DL based on a change of a waveform of a voltage Vr at a node between the pulse transformer PT and the capacitor C4 (hereinafter, referred to as a "resonance voltage"), specifically, when a voltage obtained, for example, by performing the full-wave rectification for the resonance voltage Vr and smoothing the same resonance voltage Vr falls down below a predetermined threshold value.

In the starting improvement mode to which the control circuit 3 shifts when the starting of the discharge lamp DL is detected by the starting detection circuit 4 during the no-load mode, the control circuit 3 turns on the switching device Q3 as one of the switching devices of the inverter circuit 2, turns on/off the switching device Q6 located diagonally to the switching device Q3 at several ten to several hundred kilohertz, and individually turn off the switching devices Q4 and Q5 as two residuals. In such a way, a direct current is supplied to the discharge lamp DL.

Moreover, in the lighting mode to which the control circuit 3 shifts after continuing the starting improvement mode for a predetermined time, the control circuit 3 sets the operation frequency at several ten to several hundred hertz, and instead of continuously turning on the respective switching devices Q5 and Q6 of one of the series circuits in the inverter circuit 2 as Embodiment 1, individually turns on/off the respective switching devices Q5 and Q6 at several ten to several hundred kilohertz for a period while the switching devices concerned are to be turned on.

In accordance with the above-described configuration, the control circuit 3 shifts to the starting improvement mode when the starting of the discharge lamp DL is detected in the no-load mode, whereby it becomes possible to smoothly start up the discharge lamp DL to the stable lighting without causing the fading.

Figure 8:
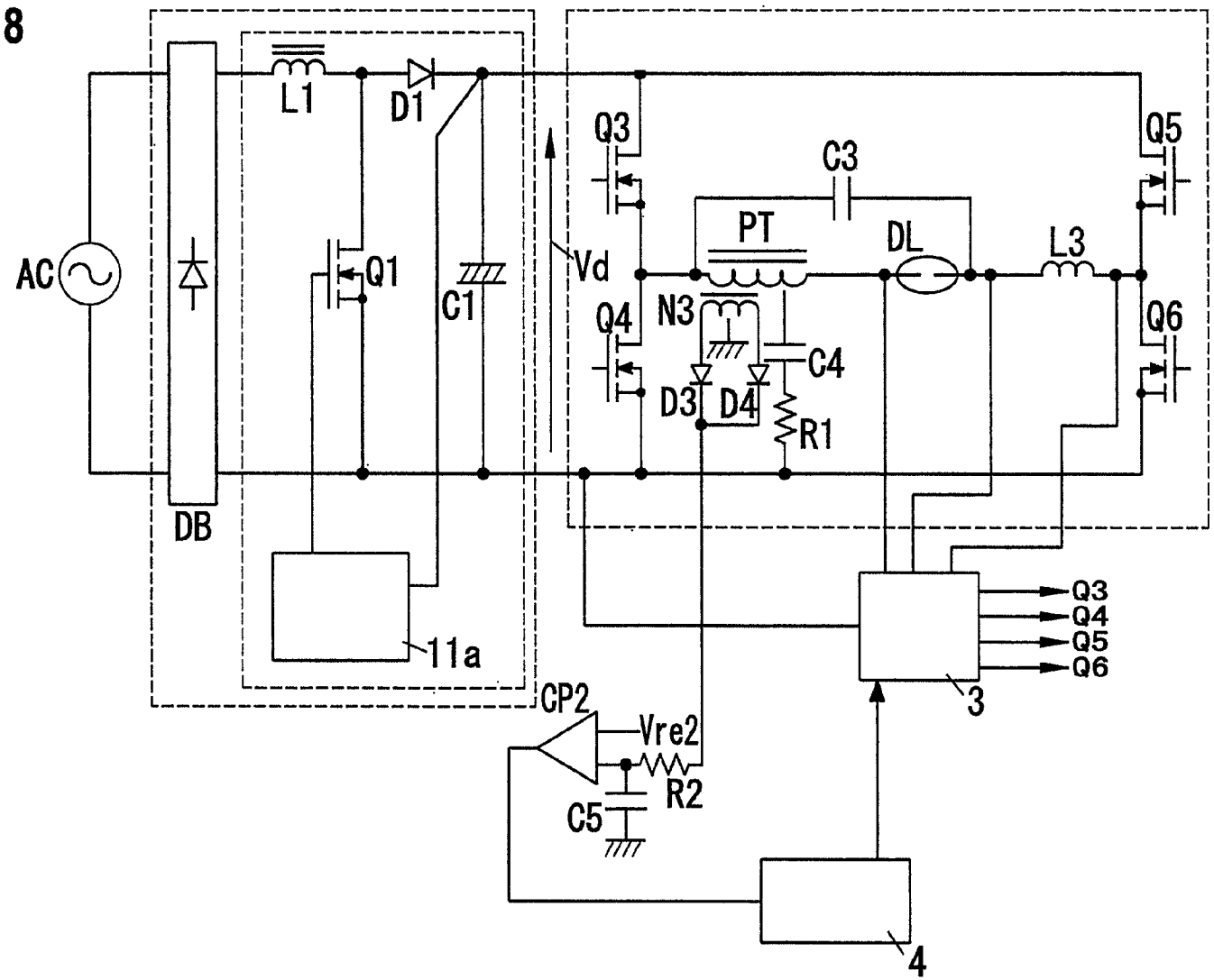
FIG. 8 is a circuit diagram showing another form of Embodiment 2.

Note that a configuration as shown in FIG. 8 may be adopted, in which a tertiary winding N3 of which center is connected to the ground is provided in the pulse transformer PT, anodes of diodes D3 and D4 are connected to both terminals of the tertiary winding N3, cathodes of the diodes D3 and D4 are connected to each other, a voltage at a node therebetween is smoothed by a capacitor C5 through a resistor R2 and is inputted to a comparator CP2 to be then compared with a predetermined reference voltage Vre2, and an output of the comparator CP2 is inputted to the starting detection circuit 4. If this configuration is adopted, then a withstand voltage required for circuit components composing the starting detection circuit 4 can be lowered. Moreover, the current corresponding to the resonance voltage Vr is used after being subjected to the full-wave rectification and the smoothing, and accordingly, reliability is enhanced in comparison with the case of detecting the instantaneous peak value of the resonance voltage Vr.

Embodiment 3

A basic configuration of this embodiment is common to that of the example of FIG. 8 in Embodiment 2, and accordingly, a description of common portions will be omitted by assigning the same reference numerals thereto.

Figure 9:
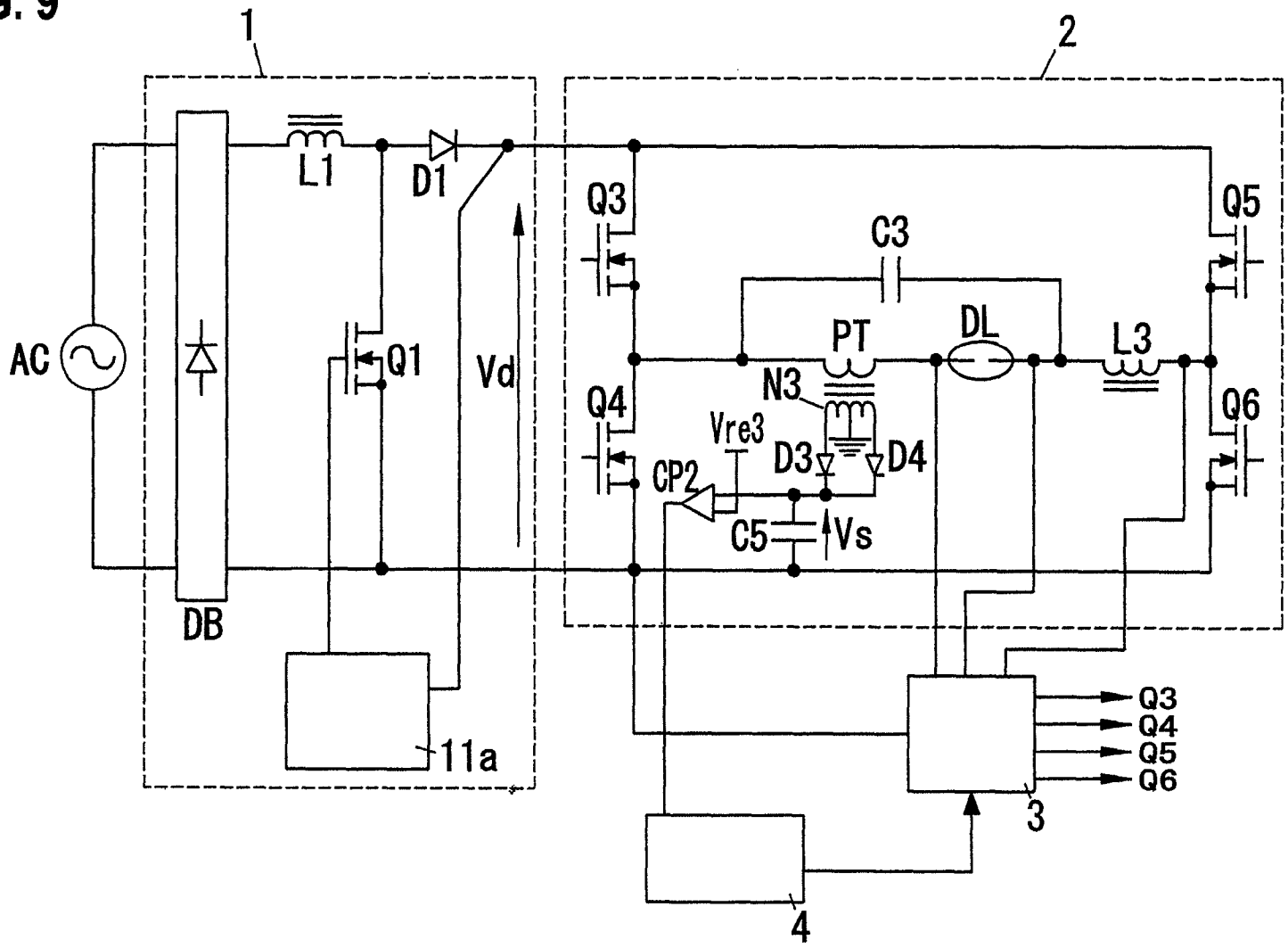
FIG. 9 is a circuit diagram showing Embodiment 3 of the present invention.

In this embodiment, as shown in FIG. 9, the capacitor C1 is omitted in the direct current power supply unit 1. Moreover, in the inverter circuit 2, the series circuit of the capacitor C4 and the resistor R1 is omitted, and the terminal in the pulse transformer PT, to which the capacitor C4 is connected, is deleted, whereby the series circuit of the primary winding N1 and the secondary winding N2, which is defined in Embodiment 2, becomes the primary winding N1 as a whole, and the tertiary winding N3 defined in Embodiment 2 becomes a secondary winding N3. Furthermore, an iron core is added to the inductor L3. In this embodiment, the capacitor C3 connected to the series circuit of the pulse transformer PT and the discharge lamp DL and the inductor L3 connected between the discharge lamp DL and the node between the switching devices Q5 and Q6 compose a resonance circuit. Moreover, the resistor R2 connected to the comparator CP2 is omitted.

The starting detection circuit 4 detects the starting of the discharge lamp DL based on the output of the comparator CP2. Specifically, when a charge voltage Vs of the capacitor C5 (hereinafter, referred to as a "starting voltage") exceeds a predetermined reference voltage Vre3, the starting detection circuit 4 detects the starting of the discharge lamp DL.

The control circuit 3 sets the operation frequency in the no-load mode at a frequency substantially equal to a resonance frequency of a resonance circuit composed of the capacitor C3 and the inductor L3.

Figure 10:
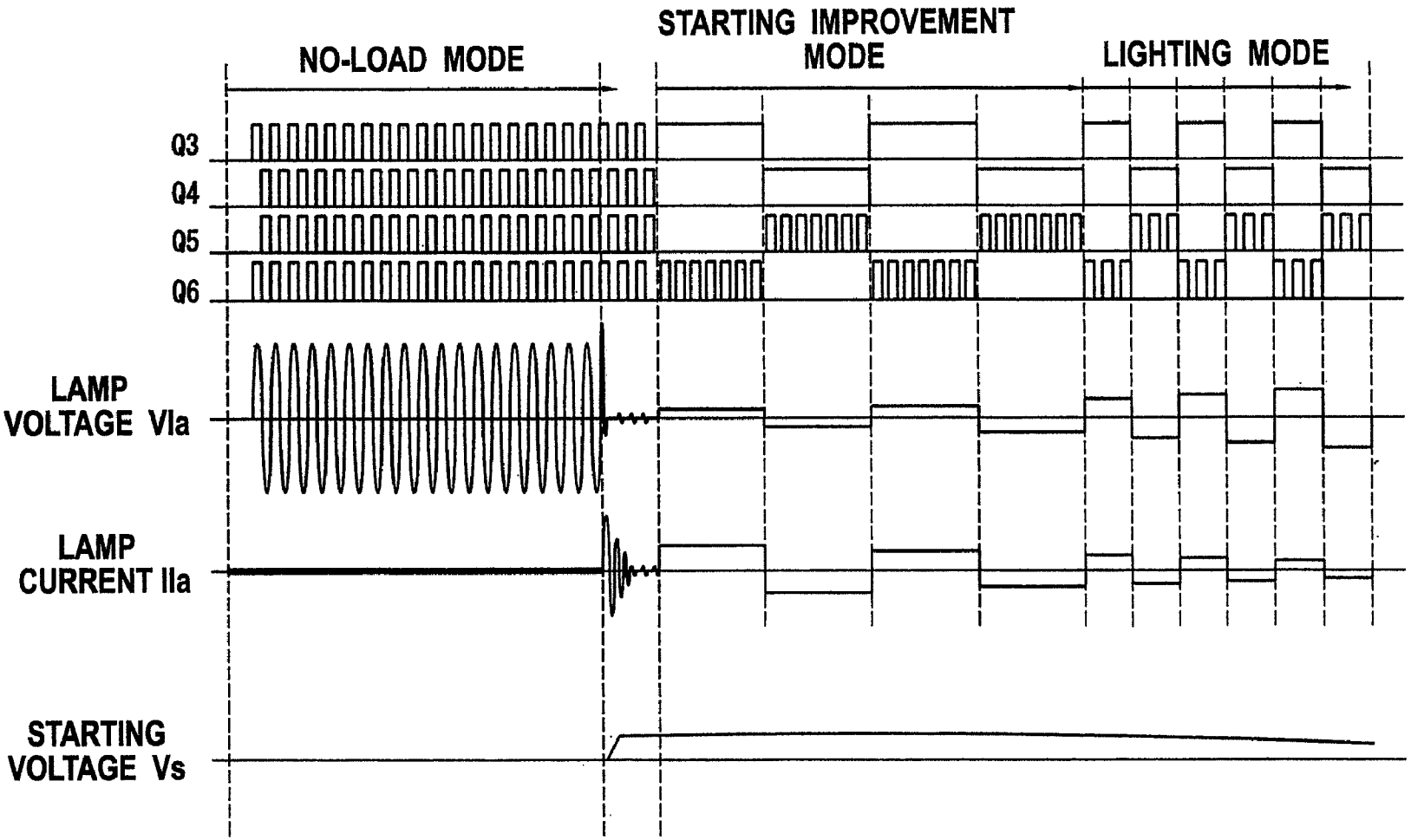
FIG. 10 is an operation instruction chart of Embodiment 3, showing on/off states of the respective switching devices, a waveform of a lamp voltage, a waveform of a lamp current and a waveform of a starting voltage while an axis of abscissas is being taken as a time.

Moreover, as shown in FIG. 10, in the starting improvement mode, the control circuit 3 sets the operation frequency at a low frequency of several ten to several hundred hertz, and turns on/off the respective switching devices Q5 and Q6 of one of the series circuits in the inverter circuit 2 at a high frequency of several ten to several hundred kilohertz for the period while the switching devices concerned are to be turned on.

Furthermore, in the lighting mode, as in Embodiment 2, the control circuit 3 sets the operation frequency at a low frequency of several hundred hertz, and individually turns on/off the respective switching devices Q5 and Q6 of one of the series circuits in the inverter circuit 2 at a high frequency of several ten to several hundred kilohertz for the period while the switching devices concerned are to be turned on.

In accordance with the above-described configuration, the control circuit 3 shifts to the starting improvement mode when the starting of the discharge lamp DL is detected in the no-load mode, whereby it becomes possible to smoothly start up the discharge lamp DL to the stable lighting without causing the fading.

Figure 11:
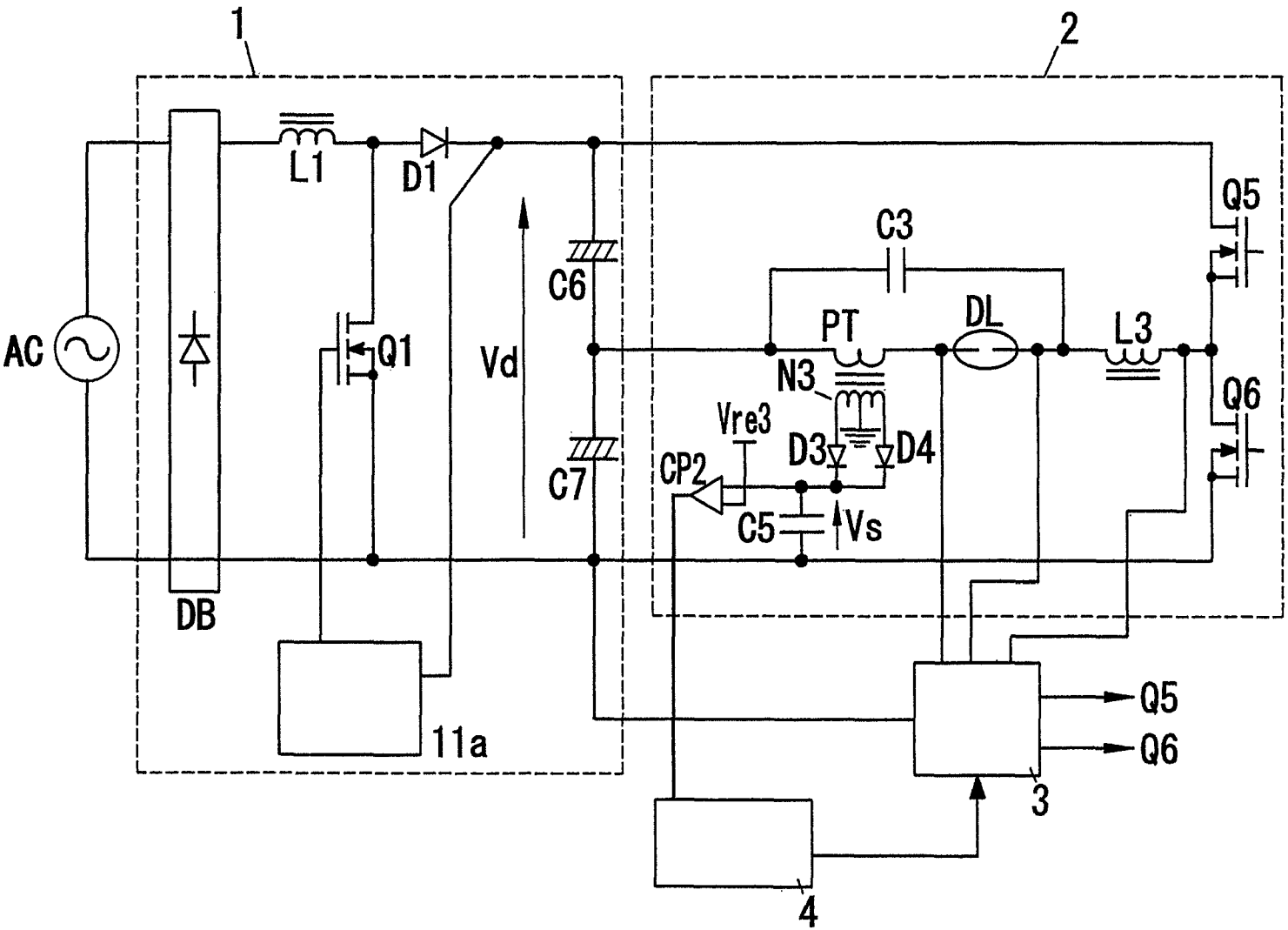
FIG. 11 is a circuit diagram showing another form of Embodiment 3.

Note that a configuration as shown in FIG. 11 may be adopted, in which the respective switching devices Q3 and Q4 which are not turned on/off at the high frequency in the starting improvement mode and the lighting mode among the switching devices Q3 to Q6 of the inverter circuit 2 are replaced by capacitors C6 and C7, respectively, and the inverter circuit 2 is made into a half bridge type.

Figure 12:
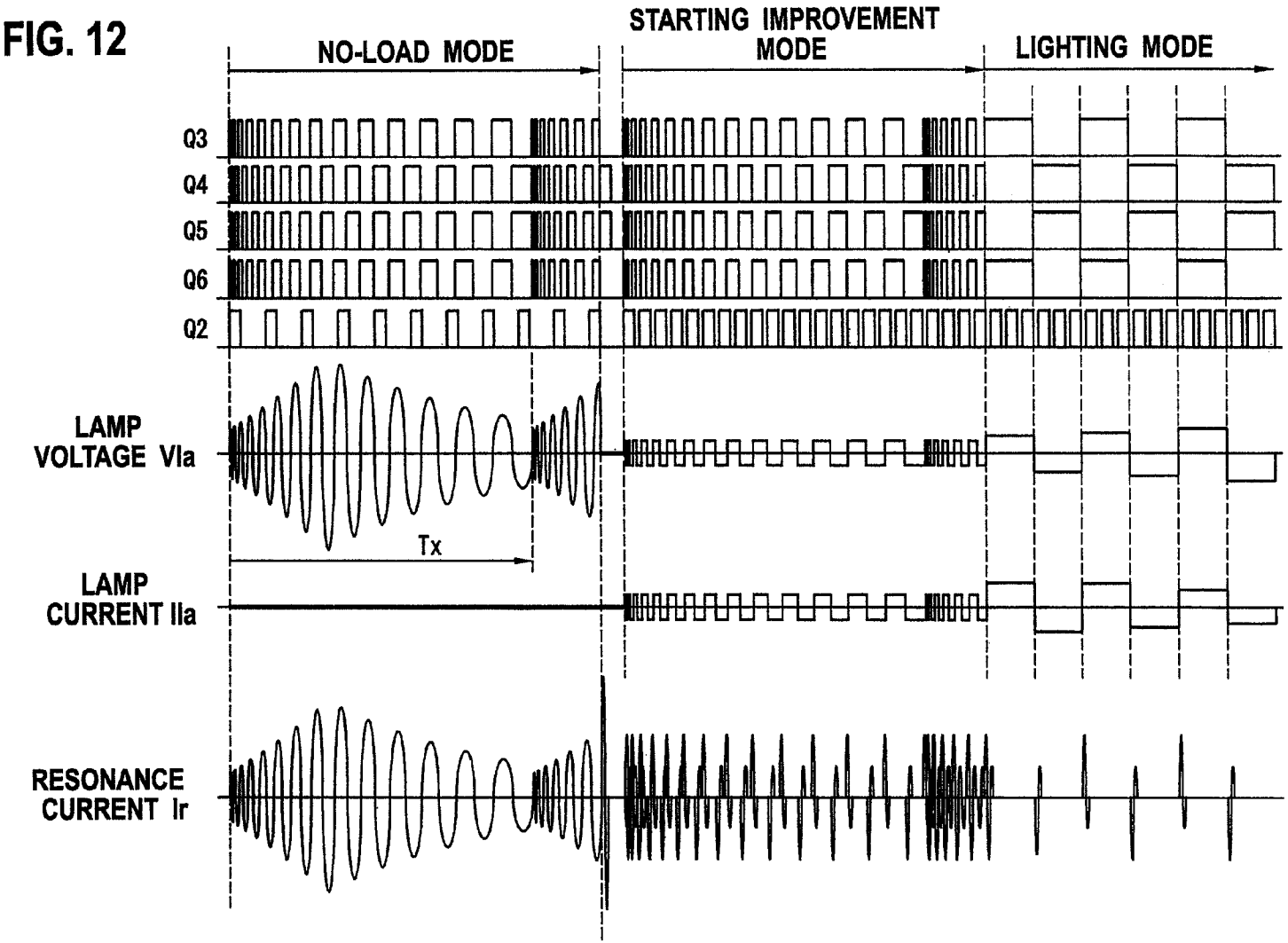
FIG. 12 is an operation instruction chart of another form of Embodiment 1, showing on/off states of the respective switching devices, a waveform of a lamp voltage, a waveform of a lamp current and a waveform of a resonance current while an axis of abscissas is being taken as a time.

Moreover, in each of Embodiments 1 to 3, as shown in FIG. 12, the control circuit 3 may perform operations, which are similar to those of the no-load mode, in the starting improvement mode. FIG. 12 only illustrates the case where this described procedure is applied to Embodiment 1, and illustrations thereof for Embodiments 2 and 3 are omitted. Moreover, in the starting improvement mode, the operation frequency may be set constant without being varied.

Figure 13:
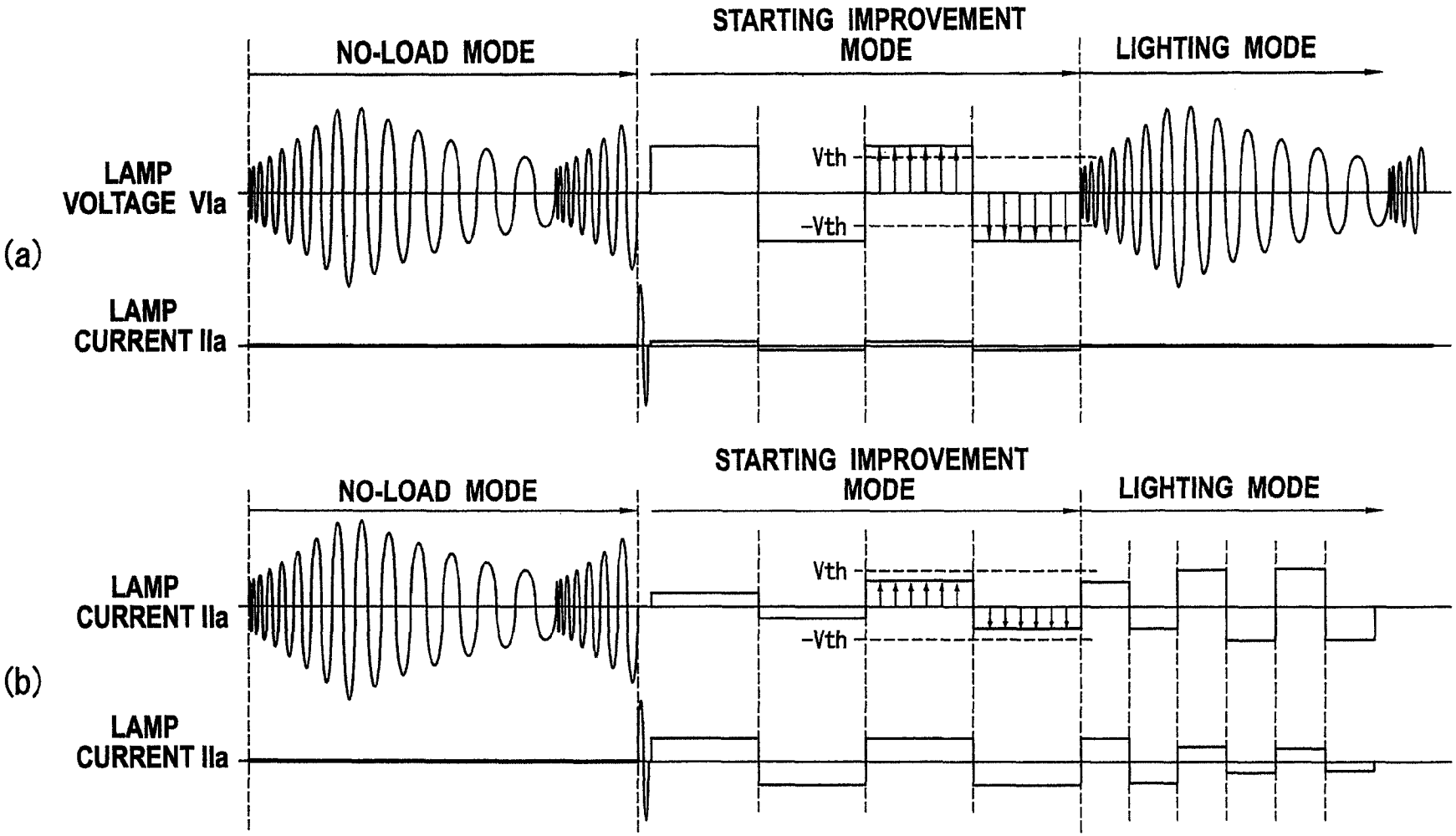
FIGS. 13(*a*) and (*b*) are operation instruction charts of still another form of Embodiment 1, each showing a waveform of a lamp voltage and a waveform of a lamp current while an axis of abscissas is being taken as a time.

Furthermore, for example, in approximately one cycle in the starting improvement mode of each of Embodiments 1 to 3 or immediately after the switching to the lighting mode in the example of FIG. 12, the control circuit 3 periodically compares the lamp voltage Vla and a predetermined lighting threshold value Vth with each other. If the lamp voltage Vla falls down below the lighting threshold value Vth as shown in FIG. 13(*b*), then the control circuit 3 determines that an arc discharge is generated in the discharge lamp DL, and continues the operations in the mode concerned and the shifting to the next mode. Meanwhile, if the lamp voltage Vla exceeds the lighting threshold value Vth as shown in FIG. 13(*a*), then the control circuit returns to the no-load mode. Then, the shifting to the lighting mode becomes more stable. Specifically, the control circuit 3 serves as a state detection circuit in the scope of claims. FIGS. 13(*a*) and 13(*b*) only show the case where this described procedure is applied to Embodiment 1, and illustrations thereof for Embodiments 2 and 3 are omitted.

Moreover, in each of Embodiments 1 to 3, a direct current power supply like a battery may be used instead of the direct current power supply circuit 1.

Figure 14:
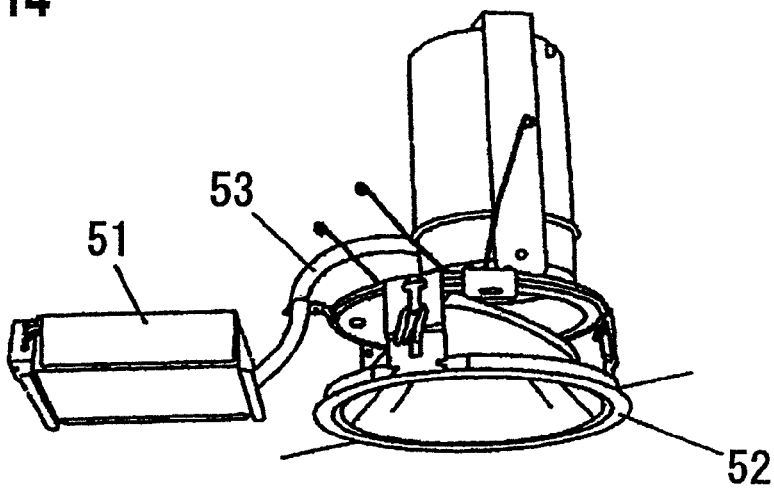
FIGS. 14(*a*) to 14(*c*) are perspective views of examples of lighting fixtures for which discharge lamp lighting devices of Embodiments 1 to 3 are individually used, showing examples different from one another.
Figure 14:
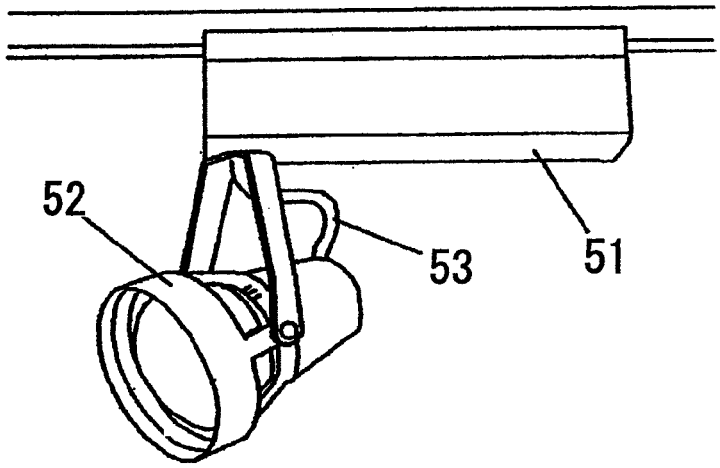
Figure 14:
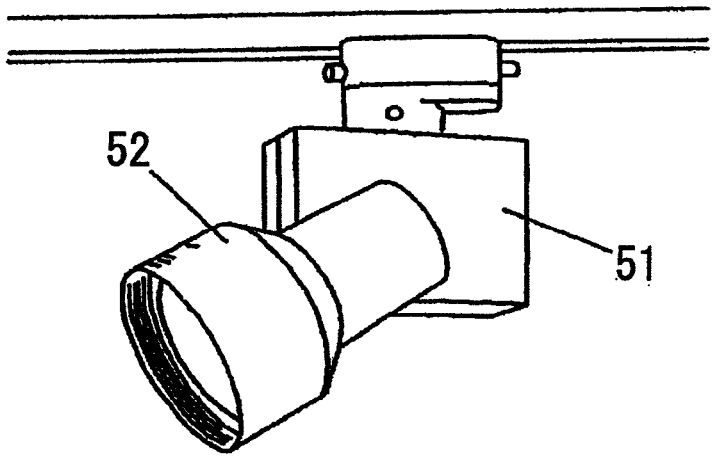
Figure 15:
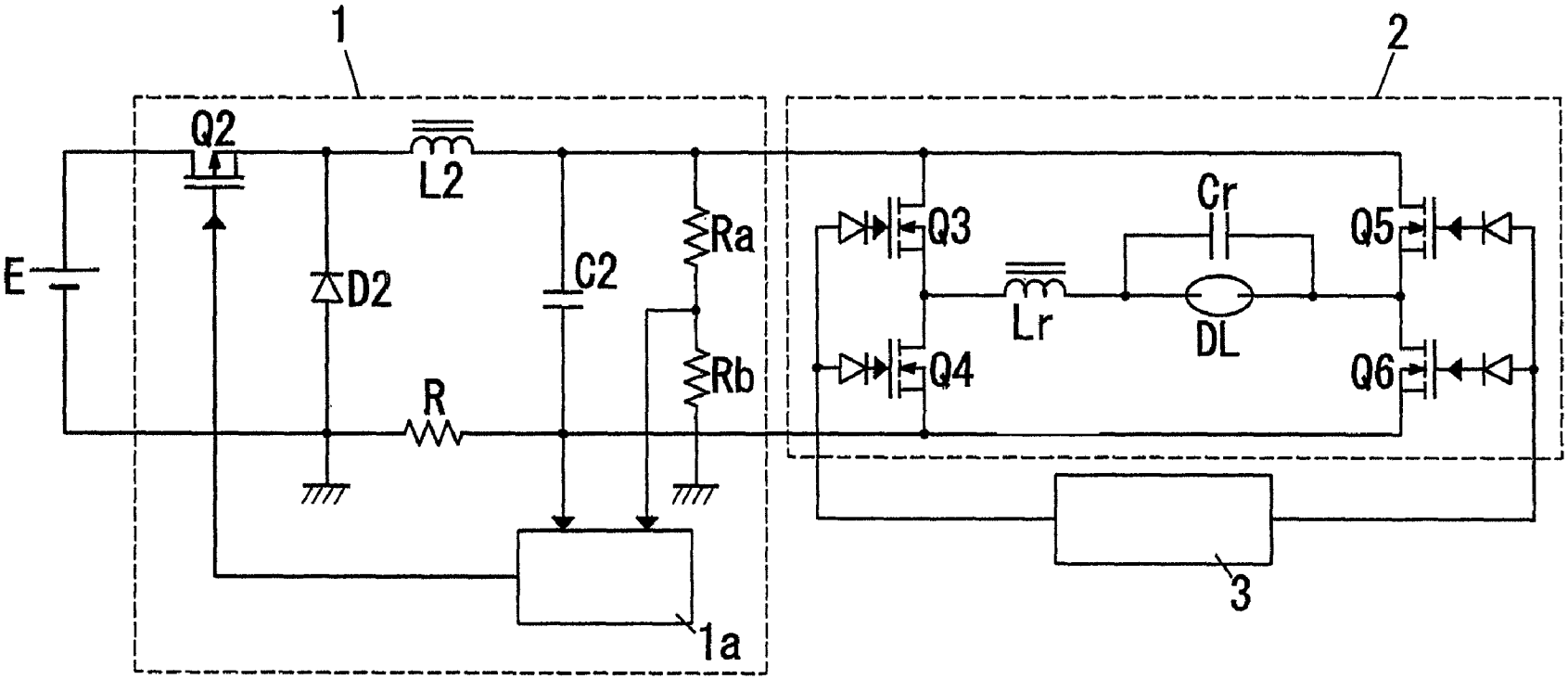
FIG. 15 is a circuit diagram showing an example of a discharge lamp lighting device.
Figure 16:
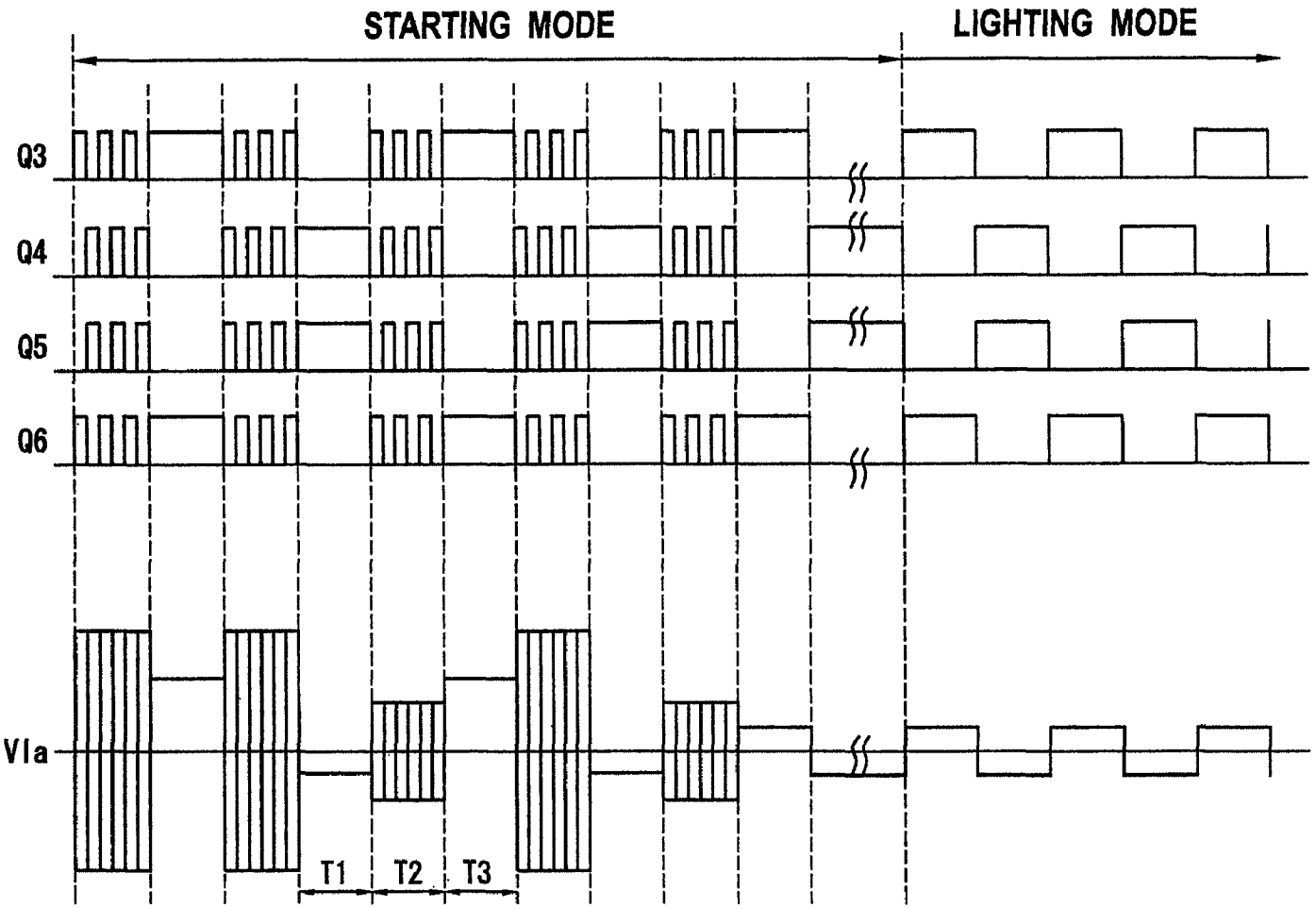
FIG. 16 is an operation instruction chart of a conventional example, showing on/off states of the respective switching devices and a waveform of a lamp voltage while an axis of abscissas is being taken as a time.

The discharge lamp lighting device of each of Embodiments 1 to 3 can be used for a variety of lighting fixtures such as, for example, a downlight shown in FIG. 14(*a*) and spotlights shown in FIGS. 14(*b*) and 14(*c*). Each of the lighting fixtures in FIGS. 14(*a*) to 14(*c*) includes: a fixture body 51 in which a printed wiring board (not shown) is housed, the printed wiring board having the respective circuit components composing the discharge lamp lighting device mounted thereon; and a lamp body 52 in which a socket (not shown) is housed, the socket having the discharge lamp DL attached thereto so as to be freely detachable therefrom. In each of examples of FIGS. 14(*a*) and 14(*b*), the discharge lamp lighting device in the fixture body 51 and the socket housed in the lamp body 52 are electrically connected to each other by an electric wire 53. Moreover, the lighting fixtures in each of FIGS. 14(*a*) to 14(*c*) can be used together with a control device (not shown) that controls the respective light fixtures, whereby a lighting system can also be constructed.

INDUSTRIAL APPLICABILITY

The present invention can be applied to such a usage purpose of smoothly shifting the discharge lamp to the stable lighting.

The invention claimed is:

1. A discharge lamp lighting device comprising:

DC power supply circuit that outputs DC power;

an inverter circuit that includes a resonance circuit having at least one capacitor and at least one inductor, and converts a DC voltage, which is output by the DC power supply circuit, into an AC voltage, the AC voltage being applied to a discharge lamp;

a start detection circuit that detects starting of a discharge in the discharge lamp; and a control circuit that controls the inverter circuit, wherein the control circuit includes:

a no-load mode in which a voltage for starting a glow discharge is applied to the discharge lamp by setting a frequency of an output of the inverter circuit at approximately a resonance frequency of the resonance circuit included in the inverter circuit;

a lighting mode in which the arc discharge is maintained by lowering the frequency of the output of the inverter circuit to be lower than the resonance frequency of the resonance circuit; and a starting improvement mode in which the frequency of the output of the inverter circuit is higher than the frequency of the output of the inverter circuit in the lighting mode, and at a time of starting of the discharge lamp, the control circuit first operates in the no-load mode, shifts to the starting improvement mode, in which the glow discharge in the discharge lamp is shifted to an arc discharge, when starting of the discharge in the discharge lamp is detected by the start detection circuit during the no-load mode, and shifts to the lighting mode, after the starting improvement mode is continued for a predetermined time.

2. The discharge lamp lighting device according to claim 1, wherein, in the starting improvement mode, the control circuit sets the frequency of the output of the inverter circuit at approximately the resonance frequency of the resonance circuit.

3. The discharge lamp lighting device according to claim 1, wherein, in the starting improvement mode, the control circuit lowers the frequency of the output of the inverter circuit to be lower than a frequency of the output of the inverter circuit in the lighting mode.

4. The discharge lamp lighting device according to claim 1, wherein, in the starting improvement mode, the control circuit controls the inverter circuit to apply a DC voltage to the discharge lamp.

5. The discharge lamp lighting device according to claim 1, further comprising:

a state detection circuit that periodically compares a lamp voltage of the discharge lamp and a predetermined threshold value with each other, thereby detecting a fading state in which the arc discharge is not generated in the discharge lamp, wherein the control circuit returns to the no-load mode when the fading state is detected by the state detection circuit in either the starting improvement mode or the lighting mode.

6. The discharge lamp lighting device according to claim 1, wherein the start detection circuit detects the starting of the discharge based on a change of a voltage at a node between the inductor and the capacitor in the resonance circuit.

7. The discharge lamp lighting device according to claim 1, wherein the resonance circuit is a series resonance circuit, and the start detection circuit detects the starting of the discharge based on a change in a current flowing in the series resonance circuit.

8. The discharge lamp lighting device according to claim 1, wherein the start detection circuit detects the starting of the discharge by detecting a current flowing through the discharge lamp.

9. A lighting fixture comprising:

the discharge lamp lighting device according to claim 1;

a socket that is electrically connected to the discharge lamp lighting device and has the discharge lamp attached thereto; and a fixture body that houses the discharge lamp lighting device therein.

10. A lighting system comprising:

a plurality of lighting fixtures, each of which is the lighting fixture according to claim 9; and a control device that controls the respective lighting fixtures.

11. The discharge lamp lighting device according to claim 1, wherein the frequency of the output of the inverter circuit in the starting improvement mode is within a range of several tens to several hundred hertz.

12. The discharge lamp lighting device according to claim 1, further comprising a comparator that compares a voltage at a node between the capacitor and a resistor of the resonance circuit with a reference voltage, and a flip-flop circuit positioned between the node and the start detection circuit.

* * * * *

UNITED STATES PATENT AND TRADEMARK OFFICE

CERTIFICATE OF CORRECTION

PATENT NO. : 8,222,830 B2
APPLICATION NO. : 12/531554
DATED : July 17, 2012
INVENTOR(S) : S. Nagata et al.

It is certified that error appears in the above-identified patent and that said Letters Patent is hereby corrected as shown below:

On Cover page (57) Abstract, line 11 of the printed patent, please change "lowered" to -- lower --

On Cover page 2 (56) References Cited, US Patent Documents, please change "YAamashita et al" to -- Yamashita et al. --

Signed and Sealed this
Ninth Day of October, 2012

David J. Kappos

David J. Kappos
*Director of the United States Patent and Trademark Office*